US005735624A

United States Patent [19]

O'Connor et al.

[11] Patent Number: 5,735,624

[45] Date of Patent: Apr. 7, 1998

[54] RELATING TO WRITING INSTRUMENTS

[75] Inventors: Stephen John O'Connor; David Anthony Edgerley, both of London, England

[73] Assignee: Parker Pen Products, Isleworth, England

[21] Appl. No.: 663,242

[22] PCT Filed: Dec. 9, 1994

[86] PCT No.: PCT/GB94/02696

§ 371 Date: Oct. 29, 1996

§ 102(e) Date: Oct. 29, 1996

[87] PCT Pub. No.: WO95/16577

PCT Pub. Date: Jun. 22, 1995

[30] Foreign Application Priority Data

Dec. 17, 1993 [GB] United Kingdom ..... 9325891

[51] Int. Cl.[6] ..... B43K 3/00

[52] U.S. Cl. ..... 401/217

[58] Field of Search ..... 401/204, 205, 401/217, 219

[56] References Cited

U.S. PATENT DOCUMENTS

| | | | |
|---|---|---|---|
| 3,877,619 | 4/1975 | Chavez, Jr. | 401/217 X |
| 4,544,297 | 10/1985 | Grossiord | 401/217 |
| 4,588,319 | 5/1986 | Niemeyer | 401/217 X |
| 4,671,692 | 6/1987 | Inaba | 401/217 X |
| 5,172,995 | 12/1992 | Felgentreu | 401/217 X |
| 5,211,495 | 5/1993 | Jozat et al. | 401/217 |

FOREIGN PATENT DOCUMENTS

| | | |
|---|---|---|
| 0240994 | 10/1987 | European Pat. Off. . |
| 0413273 | 2/1991 | European Pat. Off. . |

*Primary Examiner*—William E. Stoll

*Attorney, Agent, or Firm*—Paul T. Douglas; Chester Cekela; David A. Howley

[57] ABSTRACT

A container for ink for a writing instrument including a reservoir for containing ink, an ink feed for connection to a writing tip of a writing instrument for conveying ink from the reservoir to the writing tip, and a valve between the reservoir and the ink feed. The valve is subjected on one side to pressure in the ink feed and is subjected on another side to atmospheric pressure. The valve opens when pressure in the ink feed falls sufficiently below the atmospheric pressure acting on the valve, thereby allowing ink to flow from the reservoir to the ink feed.

15 Claims, 6 Drawing Sheets

RELATING TO WRITING INSTRUMENTS

FIELD OF THE INVENTION

The present invention relates to writing instruments and is concerned with a container for ink for a writing instrument, and more particularly to a valve for employment with a container of that type.

BACKGROUND OF THE INVENTION

There are a number of mechanisms for preventing or otherwise controlling flow of ink from a writing instrument, particularly when the writing instrument is not being used. In fountain pens, for example, ink is drawn out under capillary action during writing and otherwise generally does not flow to the writing tip, the flow of ink being controlled by a small aperture in the ink reservoir known as a "weir" through which air passes to replace ink passing to the writing tip. Such pens often have a "collector" which acts as a buffer to store ink if ink is forced out of the ink reservoir, for example, due to expansion of air in the ink reservoir.

It is an object of the present invention to provide an improved ink flow control system.

SUMMARY OF THE INVENTION

According to the present invention, there is provided a container for ink for a writing instrument, the container comprising:

a reservoir for containing ink;

an ink feed for connection to a writing tip of a writing instrument for conveying ink from the reservoir to the writing tip; and, a valve between the reservoir and the ink feed, the valve being subjected on one side to pressure in the ink feed and being subjected on another side to atmospheric pressure, the valve opening when pressure in the ink feed falls sufficiently below the atmospheric pressure acting on the valve, thereby allowing ink to flow from the reservoir to the ink feed.

The valve provides a positive closure during periods of non-writing. The valve further provides reliable control of ink flow during writing. The valve can take up less volume than a collector of a conventional fountain pen, for example, or other writing instrument, thereby providing more space to store ink. The valve can also be used in other types of writing instruments such as fibre-tipped pens and rolling-ball pens. The valve can be arranged so that ink in the reservoir tends to close the valve, which helps to ensure that ink does not pass to the writing tip if the writing instrument is accidentally dropped. The valve can be used in conjunction with a follower, a follower being a plug at the surface of the ink in the ink reservoir which follows the ink down the ink reservoir as ink is drawn off during writing.

The valve may be a resilient member which deforms under pressure to form a flow path for ink to pass to the ink feed. Alternatively, or additionally, the valve or a portion of the valve may translate on opening.

The valve my have a valve body and a valve head which normally seals an ink flow path between the reservoir and the ink feed, the valve head lying within the reservoir and the valve body being outside the reservoir and being subjected to atmospheric pressure on one side and pressure in the ink feed on another side, wherein a drop in pressure in the ink feed causes the valve head to be lifted to open the ink flow path between the reservoir and the ink feed.

The container may be a replaceable refill unit. Alternatively, the container may be provided in a writing instrument.

The container when employed as a replaceable unit may comprise a chamber having a first aperture communicating with the reservoir and a second aperture opening into the ink feed. The valve is then provided with a first arm for closing the first aperture and a second arm for closing the second aperture. The first arm is moved to open the first aperture by differential pressure acting on the valve and the second arm is held in an open position by an external component located on the writing instrument.

BRIEF DESCRIPTION OF THE DRAWINGS

Examples of the present invention will now be described with reference to the accompanying drawing, in which.

DESCRIPTION OF THE PREFERRED EMBODIMENTS

Figure 1:
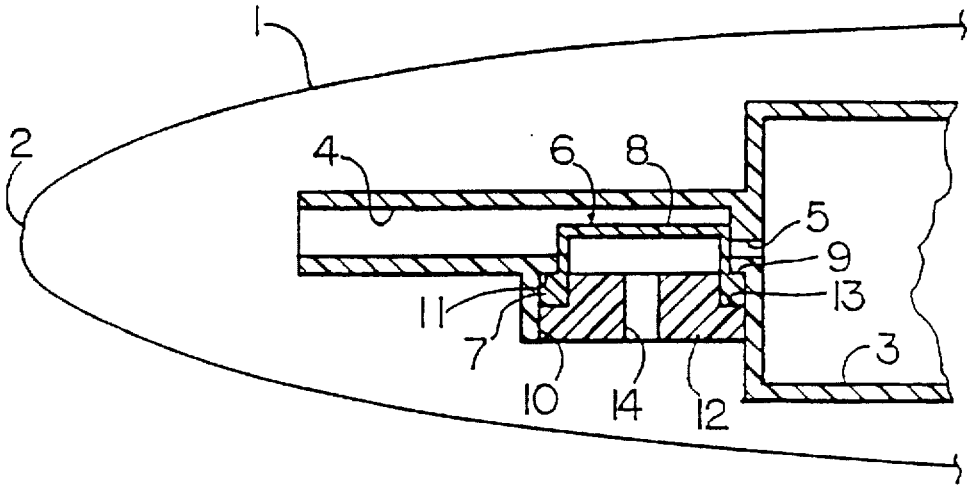
FIG. 1 is a partial cross-sectional view of a writing instrument with a first example of a valve in a closed configuration.

Throughout the following description, features in the various examples which correspond to one another have the same reference numerals.

Figure 2:
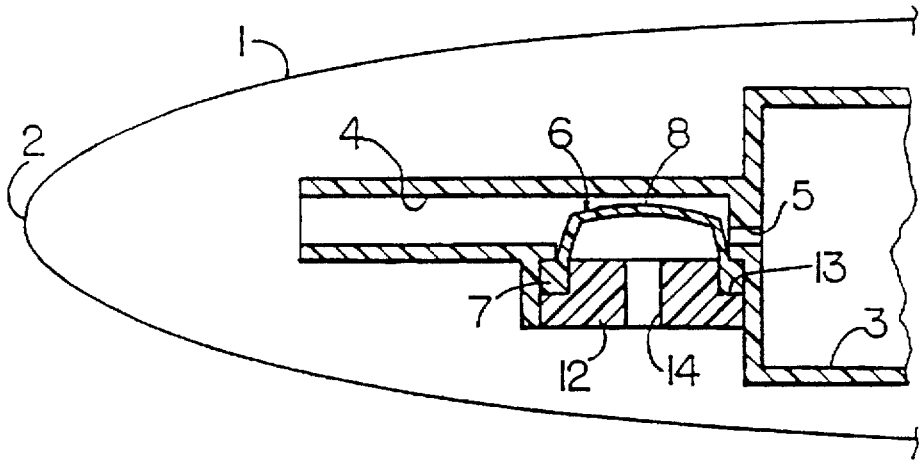
FIG. 2 is a partial cross-sectional view of the writing instrument of FIG. 1 with the valve in an open configuration.
Figure 3:
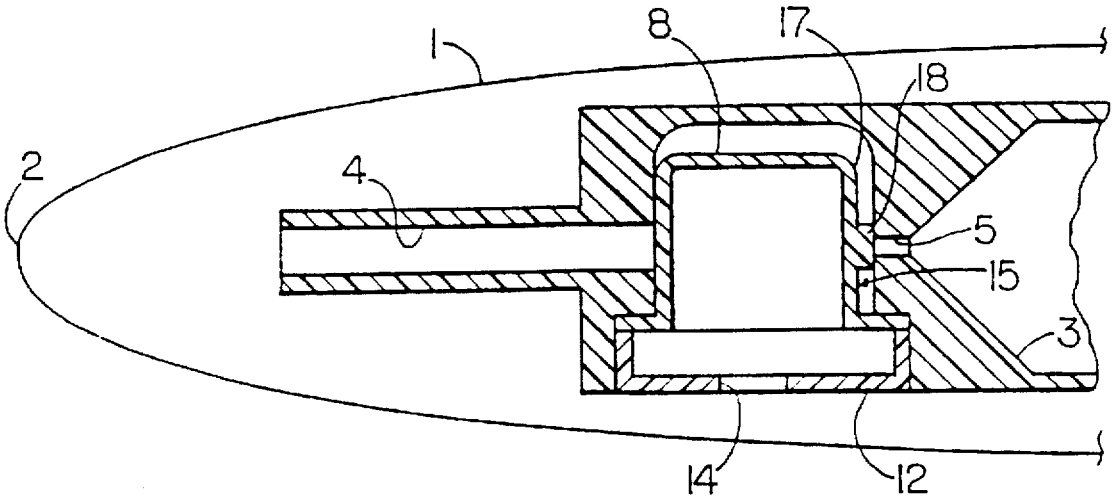
FIG. 3 is a partial cross-sectional view from one side of a writing instrument with a second example of a valve in a closed configuration.

Referring to FIGS. 1 and 2, a writing end of a writing instrument 1 is shown, the writing instrument 1 having a writing tip 2. The writing instrument 1 has a reservoir 3 for containing ink which will usually be at atmospheric pressure, though it is possible that the ink may be at a pressure above atmospheric pressure. An ink feed chamber 4 conducts ink from the reservoir 3 to the writing tip 2, ink passing through a small aperture 5 in the reservoir to the ink feed chamber 4. The ink feed chamber 4 may be a simple hollow capillary tube, or capillary slots, or may include or consist of fibrous/porous material which becomes saturated with ink which is then drawn off during writing.

A valve 6 is generally cup-shaped, having a circular cross-section and a bottom portion 7 of relatively greater diameter than the top portion 8, there being a step 9 between the top and bottom portions 8, 7. The valve 6 is made of a resiliently flexible material such as silicone rubber. The valve 6 sits in a recess 10 in the writing instrument 1, with the step 9 in the valve 6 being held against a step 11 in the recess 10 by a retainer 12. The retainer 12 may be a push fit in the recess 10 to keep the valve 6 in position. An annular ridge (not shown) may be provided in the recess 10 which may fit in an annular recess in the retainer 12 as a "click-fit". Alternatively or additionally, the retainer 12 may be fixed in the recess 10 by any suitable means such as adhesive.

The retainer 12 has a step 13 on which the lower face of the bottom portion 7 of the valve 6 sits so that a portion of the retainer 12 enters the hollow interior of the valve 6 to ensure accurate and secure retention of the valve 6 in the recess 10. The retainer 12 has a central through-hole 14 which is open on one side to the atmosphere and on the other to the interior of the valve 6. Thus, the through-hole 14 in the retainer 12 means that atmospheric pressure is applied to the interior of the valve 6.

The top portion 8 of the valve 6 projects into the ink feed chamber 4 and its side wall normally seals the aperture 5 in the reservoir 3, thereby normally preventing ink from flowing from the reservoir 3 to the ink feed chamber 4. As the top portion 8 of the valve 6 projects into the ink feed chamber, it is subjected on its outside to the ambient pressure in the ink feed chamber 4.

When the writing instrument is used for writing, ink flows out of the ink feed chamber 4 onto the paper or other medium. This causes the pressure in the ink feed chamber 4 to drop relatively to atmospheric pressure. Since the interior of the valve 6 is subjected to atmospheric pressure, there is a net force acting on the interior of the valve 6. When the pressure differential is sufficient, the net force causes the relatively large top face of the top portion 8 of the valve 6 to bow outwards as shown in FIG. 2, which in turn causes the relatively short side wall of the top portion 8 to bow inwards. As the side wall bows inwards, the aperture 5 in the reservoir 3 is unsealed, putting the reservoir 3 in fluid communication with the ink feed chamber 4. Ink is therefore drawn from the reservoir 3 to replenish the ink feed chamber 4 from where it can pass to the writing tip 2 as necessary.

When writing is stopped, the ink feed chamber 4 fills with ink and the pressure in the ink feed chamber 4 rises again. This causes the top face of the valve 6 to flatten, thereby pushing the side wall outwards and sealing the aperture 5 in the reservoir 3. Ink is therefore again prevented from flowing from the reservoir 3 to the ink feed chamber 4. It should be noted that the valve 6 may oscillate between open and closed as writing proceeds, according to, for example, the speed of writing and the pressure variations associated with ink being drawn from the ink feed chamber 4.

FIGS. 3 to 6 show a writing end of a writing instrument 1 having a second example of a valve 15. The second example of the valve 15 is similar to the first example of the valve 6 shown in FIGS. 1 and 2. However, in this second example, the valve 15 has an elliptical cross-section with a relatively short minor axis and a relatively large major axis so that the valve 15 generally has a tall, narrow shape. The valve 15 therefore has two large flat opposed side walls 16 and two narrow opposed side walls 17. On the narrow-side wall 17 adjacent the aperture 5 is a projecting boss 18 which is of a size and shape normally to seal the aperture 5 in the reservoir 3.

Figure 4:
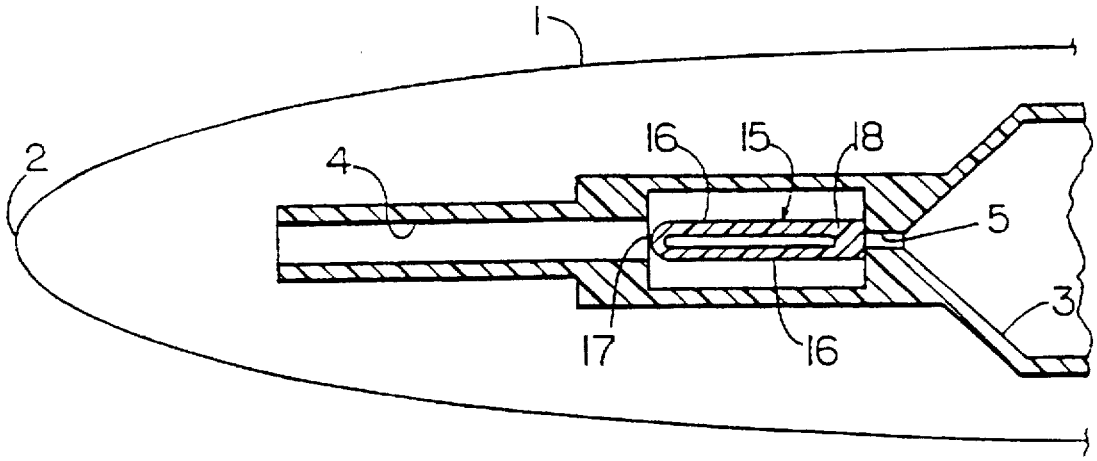
FIG. 4 is a partial cross-sectional view from above of the writing instrument of FIG. 3.
Figure 5:
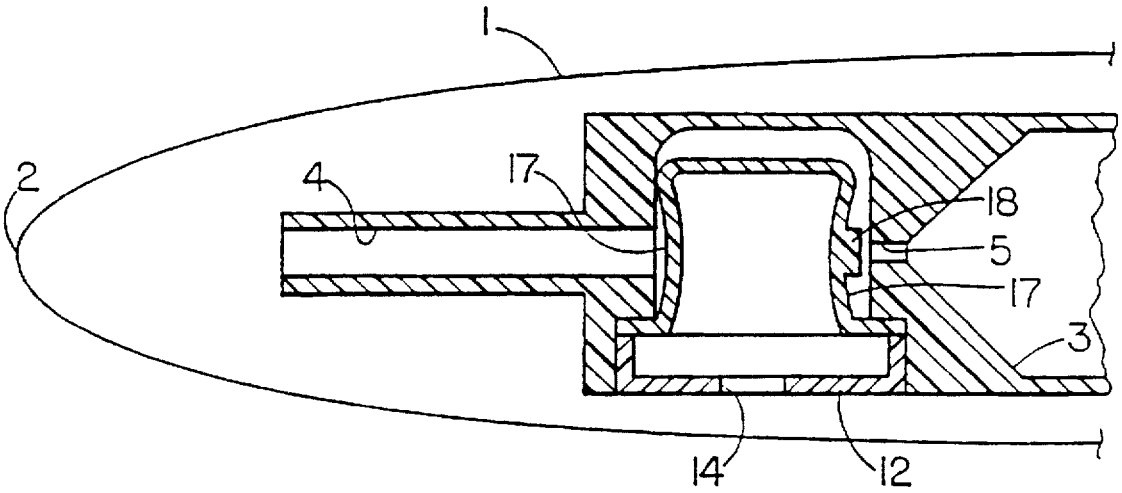
FIG. 5 is a partial cross-sectional view from one side of the writing instrument of FIG. 3 with the valve in an open configuration.
Figure 6:
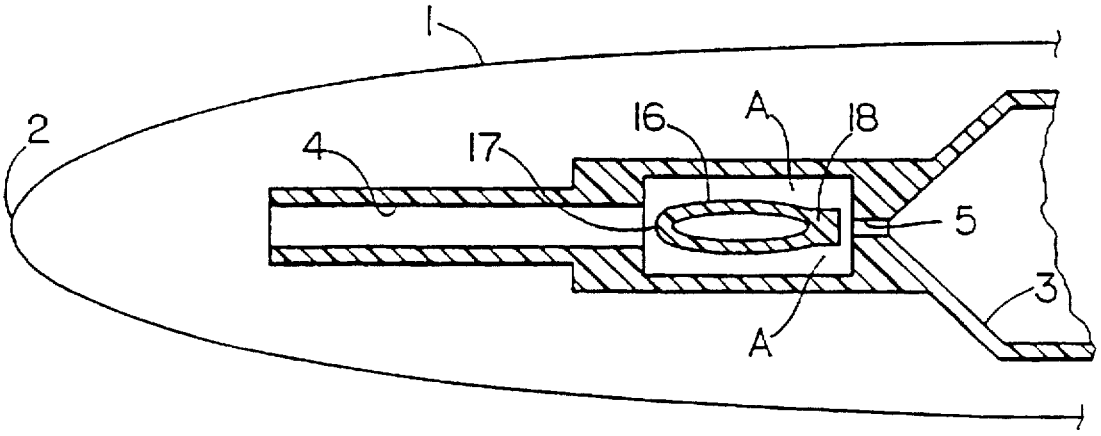
FIG. 6 is a partial cross-sectional view from above of the writing instrument of FIG. 5.

Because of the tall, narrow shape of the valve 15, during writing, when the pressure in the ink feed chamber 4 drops relative to the atmospheric pressure which is applied to the interior of the valve 15 through the through-hole 14 in the retainer 12, the large flat side walls 16 of the top portion 8 of the valve 15 bow outwards as can be seen by a comparison of FIG. 4 with FIG. 6. This pulls the thin side walls 17 inwards, thus pulling the boss 18 away from the aperture 5 in the reservoir 3 and opening fluid communication between the reservoir 3 and the ink feed chamber 4 as can be seen by a comparison between FIGS. 3 and 5. Ink can therefore flow around the valve 15 along a flow path A to the ink feed chamber 4 to replenish ink which is drawn from the ink feed chamber 4. When writing stops and the pressure in the ink feed chamber 4 rises sufficiently, the large side walls 16 can relax inwards towards each other, pushing the thin side walls 17 outwards to seal the aperture 5.

Figure 7:
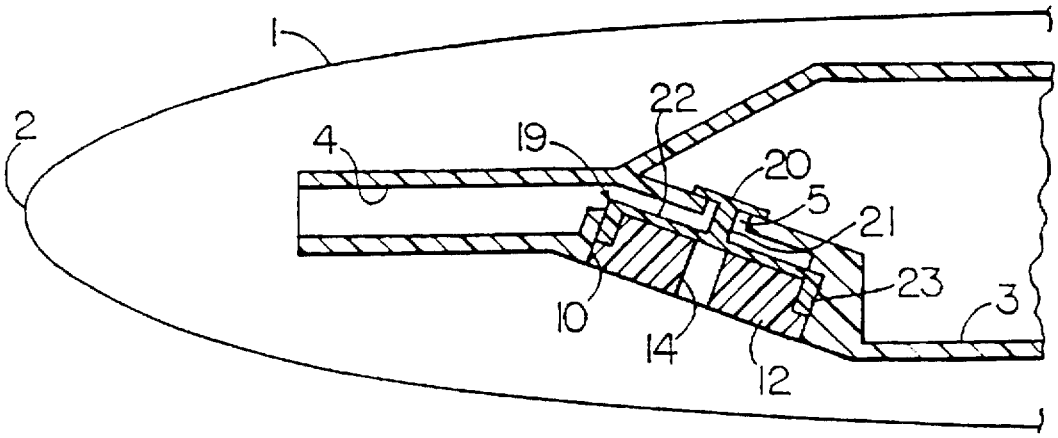
FIG. 7 is a partial cross-sectional view of a writing instrument with a third example of a valve in a closed configuration.
Figure 8:
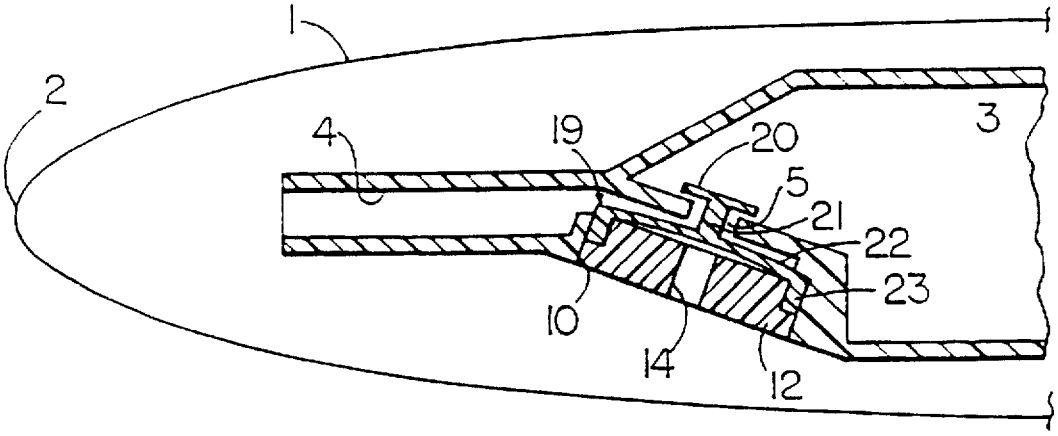
FIG. 8 is a partial cross-sectional view of the writing instrument of FIG. 7 with the valve in an open configuration.

A third type of valve 19 is shown in FIGS. 7 and 8. The valve 19 is generally cup-shaped and is retained in the recess 10 in the writing instrument 1 by the retainer 12. In contrast to the first two examples of valves described above, in which the aperture 5 in the reservoir 3 is sealed by a side wall or a boss on the side wall of the valve, the valve 19 of the third example has a valve head 20 on a valve stem 21 which is part of the top face 22 of the main valve body 23. The valve head 20 sits inside the reservoir 3 and normally seals the aperture 5. The valve stem 21 sits in the aperture 5 and is of sufficiently small diameter to leave a gap around its circumference between the valve stem 21 and the edge of the aperture 5.

The top, outer face 22 of the valve 19 is spaced from the end wall of the reservoir 3 having the aperture 5 so that it is subjected on one side (the side having the valve head 20) to pressure in the ink feed chamber 4. The other, inner side of the top face 22 is subjected to atmospheric pressure through the through-hole 14 in the retainer 12.

As ink is drawn off from the writing tip 2, and pressure in the ink feed chamber 4 drops, the relatively greater atmospheric pressure acting on the inner side of the top face 22 of the valve 19 causes the top face 22 to bow outwards as can be seen in FIG. 8. This outwards bowing causes the valve head 20 to lift, thereby opening the aperture 5. Ink can therefore flow from the reservoir 3, through the aperture 5 (passing around the valve stem 21), to the ink feed chamber 4 and thence to the writing tip 2. When writing is stopped, the pressure in the ink feed chamber 4 rises allowing the top face 22 to flatten again, thereby pulling the valve head 20 against the reservoir wall to close the aperture 5.

In this example, ink pressure in the reservoir 3 tends to close the valve 19 since it pushes the valve head 20 into sealing engagement with the aperture 5 in the reservoir 3. Thus, if the writing instrument is dropped, for example, or pressure in the reservoir 3 rises relative to the ambient atmospheric pressure, e.g. due to the writing instrument being taken to altitude in an aircraft or due to warming of the writing instrument in use, there is a tendency for the valve 19 to close even more firmly, ensuring a good seal.

Referring now to FIGS. 9 through 12 there is shown a preferred embodiment of the invention in which a writing instrument 1 having a writing tip 2 is provided with an equilibrium valve cartridges 30 as shown. The valve cartridge 30 is fabricated of wall structure forming a reservoir 3 for containing ink which is generally at atmospheric pressure and an ink chamber 4 for conducting ink from the reservoir 3 to the writing tip 2. The wall structure additionally provides a valve chamber 31 having a first aperture 32 opening into the reservoir 3 and a second aperture 34 communicating between the valve chamber and the ink feed chamber 4.

Figure 12:
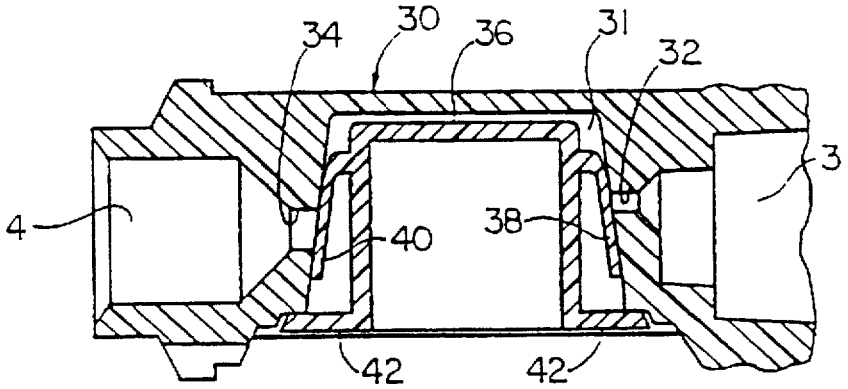
FIG. 12 is a partial cross-sectional view from one side of the valve prior to insertion in the writing instrument.

As best shown in FIG. 12, a valve 36 is disposed within the valve chamber 31, the valve being of substantially elliptical cross-section with a short minor axis and a relatively large major axis, similar to the valve structure of FIGS. 3 to 6. However, in the present valve embodiment, the valve 36 is provided with a pair of resilient arms 38 and 40 extending downwardly and outwardly from the body of the valve 36. The main body of the valve 36 is of resiliently flexible material as described above and is in the form of a cup, open at the bottom to atmospheric pressure, and having a bottom wall 42 which extends outwardly from the cup portion and is sealingly engaged with the bottom of the valve chamber 31. The bottom wall 42 of the valve 36 may be sealed at the opening of the valve chamber 31 by any suitable means such as an adhesive, the only requirement being that the seal be of a type which will retain the differential pressure to which the valve 36 is subjected during use. Referring still to FIG. 12 it will be noted that prior to assembly of the valve cartridge into the writing instrument 1, the resilient arm 38 is biased outwardly from the main body of the valve 36 and is in sealing engagement with the first aperture 32 while the resilient arm 40 is biased outwardly and is in sealing engagement with the second aperture 34.

Figure 9:
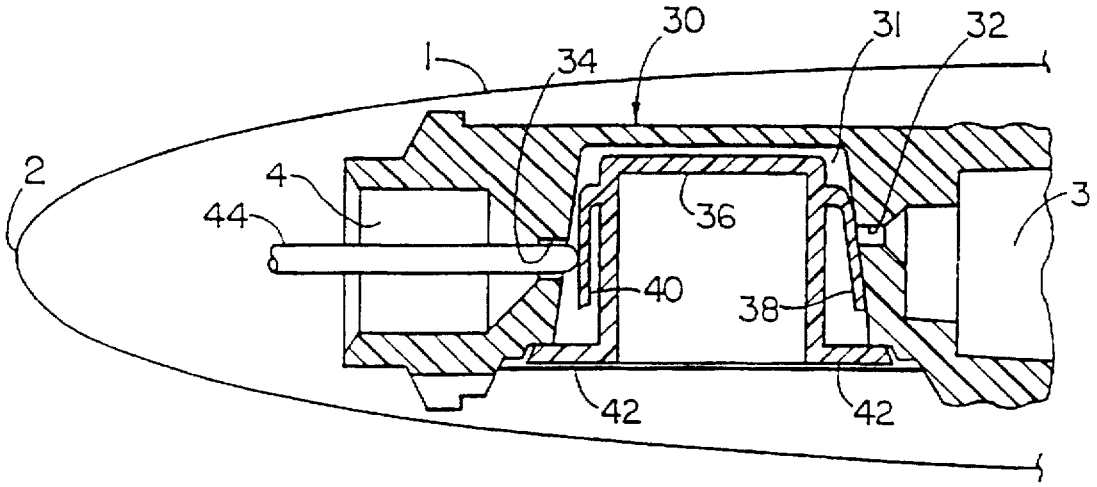
FIG. 9 is a partial cross-sectional view from one side of a writing instrument with a fourth example of a valve in a closed position.
Figure 10:
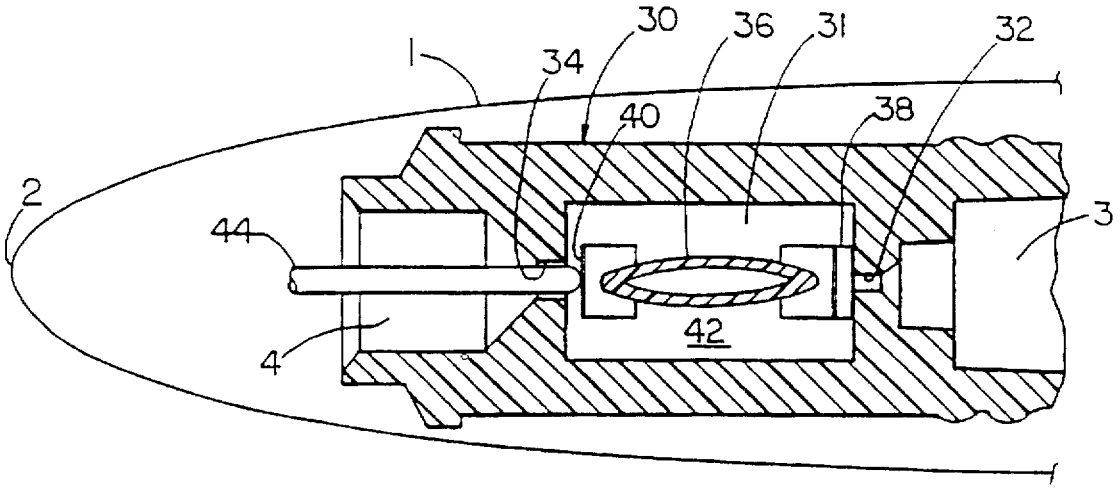
FIG. 10 is a partial cross-sectional view from above of the writing instrument of FIG. 9.
Figure 11:
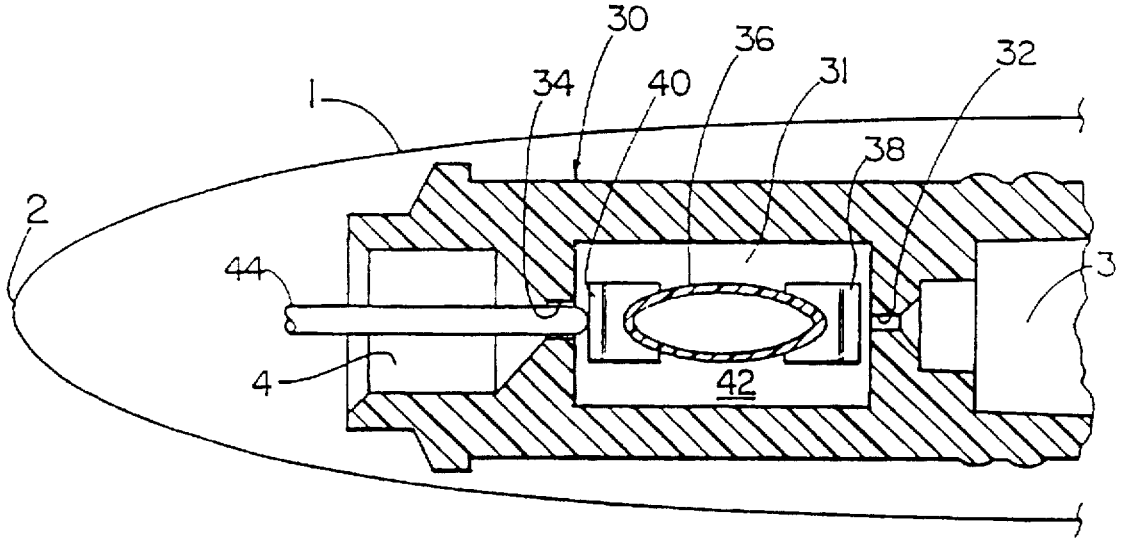
FIG. 11 is a partial cross-section from above of the writing instrument of FIGS. 9 and 10 with the valve in an open configuration.

As best shown in FIGS. 9, 10 and 11 when the valve cartridge 30 is assembled into the writing instrument 1, an arm displacement component 44 which is mounted in the writing instrument and aligned with the second aperture 34 extends through the aperture and contacts the resilient arm 40 to displace it from the aperture 34 and thus to retain the aperture open during usage of the cartridge 30. The arm displacement component 40 may take the form of a single ink channel capillary slot through which the ink flows during operation of the writing instrument, a multiporous feed stick or even may take the form of a conventional piercer tube mechanism. It should therefore be understood that while the arm 40 is effective to maintain a positive seal against ink flow through the aperture 34 prior to installation of the valve cartridge 30 into the writing instrument 1, after installation and during usage, the resilient arm 40 is retained in the open position, being displaced by the component 44.

In operation, the valve 36 functions in a similar manner to those embodiments previously discussed. When the writing instrument is employed, ink flows out of the feed chamber 4 onto the paper or other medium which causes the pressure in the ink feed chamber to drop relatively to atmospheric. Again, as the interior of the valve 36 is maintained at atmospheric, there is a net force acting on the interior of the valve and when the pressure differential is sufficient, the net force causes the thin walls of the valve to bow outwardly as shown in FIG. 11. As the side walls bow outwardly, the relatively small end walls move inwardly moving the resilient arm 38 inwardly, and causing the arm 38 to be displaced from the aperture 32 allowing ink to flow from the reservoir 3 into the valve chamber 31 and then outwardly into the feed chamber 4. Ink is therefore continuously drawn from the reservoir 3 to replenish the ink feed chamber 4, from where it is caused to pass to the writing tip 2 as necessary.

Each of the valves described above may be used in a replaceable refill unit for a writing instrument or may be integrally provided in a writing instrument.

We claim:

1. An ink container including a reservoir for containing ink, and feed means for conveying ink from said reservoir, characterized by valve means disposed between said reservoir and said feed means for controlling ink flow to said feed means, said valve means being subjected on one side to pressure in said feed means and on another side to air at atmospheric pressure, said valve means opening when pressure in said feed means falls sufficiently below atmospheric pressure acting on said valve, thereby allowing ink to flow from said reservoir to said feed means.

2. An ink container according to claim 1, characterized in that said ink container is connected to a pen writing tip.

3. An ink container according to claim 1, characterized in that said valve means comprises a resilient member which is deformable under pressure to form a flow path for ink to pass to the feed means.

4. An ink container according to claim 3, characterized in that the resilient member comprises a generally cup-shaped valve having side walls and a circular top wall formed of resiliently flexible material, said valve being disposed adjacent an aperture leading from said ink reservoir to said feed means with a side wall of said valve in sealing engagement with said aperture when the pressure in said feed means is at atmospheric, characterized in that a drop in pressure in said feed means causes said top wall to expand and said side wall to move away from said aperture thereby causing ink to flow from said reservoir to said feed means.

5. An ink container according to claim 3, characterized in that the resilient member comprises a generally cup-shaped valve having side walls and a circular top wall formed of resiliently flexible material disposed adjacent an aperture leading from said ink reservoir to said feed means, said valve having a valve head connected to said circular wall by a valve stem, said valve head remaining in sealing engagement with said aperture when the pressure in said feed means is at atmospheric and in that a drop in pressure in said feed means causes said top wall to expand moving said valve upwardly and away from said aperture causing ink to flow from said reservoir to said feed means.

6. An ink container according to claim 3, characterized in that the resilient member comprises a cup-shaped valve of elliptical cross-section having a relatively long major axis formed of two elongated opposed side walls and a shorter minor axis formed of two narrow opposed end walls, said reservoir having an aperture formed therein disposed adjacent one of said valve end walls and said one end wall being provided with a boss extending outwardly therefrom for sealing said aperture when the pressure in said ink feed means is at atmospheric pressure, and said side walls of said valve being forced outwardly from one another when the pressure in said feed means drops below atmospheric pressure causing said end walls to move inwardly toward one another and thereby moving said boss from said aperture and causing ink to flow from said reservoir to said feed means.

7. An ink container according to claim 1, characterized in that said valve means comprises a valve body and a valve head said valve head normally disposed in sealing engagement with the ink flow path between said ink reservoir and said ink feed means, in that said valve head is disposed within said reservoir, and in that said valve body lies outside said reservoir and is disposed such that one side thereof is disposed to atmospheric pressure and the other side thereof is disposed to said ink feed means, whereby a drop in pressure in said ink feed means causes said valve head to lift and open the ink flow path between said reservoir and said ink feed means.

8. An ink container according to claim 1, characterized in that the feed means includes a hollow capillary tube.

9. An ink container for a writing instrument, said container comprising a reservoir for containing ink and feed means for conveying ink from said reservoir, characterized in that a wall structure forming a chamber between said reservoir and said feed means has a first aperture opening into said ink reservoir and a second aperture opening into said feed means, and in that valve means is disposed in said chamber for controlling ink flow to said feed means, said valve means being subjected on one side to pressure in said feed means and on another side to air at atmospheric pressure, said valve means opening when pressure in said feed means falls sufficiently below atmospheric pressure acting on said valve, thereby allowing ink to flow from said reservoir to said feed means.

10. An ink container according to claim 9, characterized in that said valve means comprises a resilient arm having a surface covering said first aperture when pressure in said feed means is at or above atmospheric pressure and in that said surface is moved to uncover said first aperture when said pressure in said feed means falls sufficiently below atmospheric pressure.

11. An ink container according to claim 9, characterized in that said valve means comprises a resilient valve member which is deformable under pressure to form a flow path between said first aperture and said second aperture for ink to pass to said feed means.

12. An ink container according to claim 11, characterized in that said resilient member comprises a cup-shaped valve of elliptical cross-section having a relatively long major axis formed of two elongated opposed side walls and a shorter minor axis formed of two narrow opposed end walls.

13. An ink container according to claim 12, characterized in that said cup-shaped valve comprises a resilient arm disposed on a narrow end wall adjacent said first aperture and having a surface covering said first aperture when pressure in said feed means is at or above atmospheric pressure, said side walls of said valve being forced outwardly from one another when the pressure in said feed means drops below atmospheric pressure causing said end walls to move inwardly toward one another moving said arm surface from said aperture and causing ink to flow from said reservoir to said feed means.

14. An ink container according to claim 13, characterized in that said cup-shaped valve further comprises a second resilient arm disposed on a narrow end wall of said valve adjacent said second aperture and having a surface for covering said second aperture, said surface being aligned with said second aperture for contact by external means protruding through said aperture to maintain said resilient arm and said surface in spaced relation with said aperture during usage of said ink container in said writing instrument.

15. A writing instrument having an ink container disposed therein, said ink container comprising a reservoir for containing ink; and feed means for carrying ink from said reservoir, characterized by a wall structure defining a chamber between said reservoir and said feed means, said wall structure having a first aperture opening into said ink reservoir and a second aperture opening into said feed means, a valve member disposed in said chamber for controlling ink flow to said feed means said valve member being in the form of a cup shape of elliptical cross-section having a relatively long major axis formed of two elongated opposed side walls and a shorter minor axis formed of two narrow opposed end walls, a first resilient arm disposed on one narrow end wall of said valve member adjacent said first aperture and having a surface covering said first aperture when pressure in said feed means is above atmospheric pressure, a second resilient arm disposed on the other narrow end wall of said valve member adjacent said second aperture and having a surface for covering said second aperture, and means disposed on said writing instrument external of said ink container for extending through said second aperture to force said second resilient arm surface from said second aperture to allow flow of ink through said second aperture, said valve member being subjected on one side to pressure in said feed means and on the other side to atmospheric pressure such that said side walls of said valve are forced outwardly from one another when the pressure in said feed means drops below atmospheric pressure causing said end walls to move inwardly toward one another to move said first arm surface from said aperture and thereby causing ink to flow from said reservoir to said feed means.

* * * * *